United States Patent [19]

Michaelsen

[11] 4,095,717

[45] Jun. 20, 1978

[54] SAFETY OVERCAP FOR STANDARD METAL SCREWCAPS

[75] Inventor: Roy A. Michaelsen, Chicago, Ill.

[73] Assignee: Almar Enterprises, Inc., Royal Palm Beach, Fla.

[21] Appl. No.: 755,182

[22] Filed: Dec. 29, 1976

[51] Int. Cl.[2] ..... B65D 55/02; B65D 85/56; A61J 1/00

[52] U.S. Cl. ..... 215/220

[58] Field of Search ..... 215/220, 219, 301

[56] References Cited

U.S. PATENT DOCUMENTS

| | | | |
|---|---|---|---|
| 3,055,524 | 9/1962 | Glasbrenner | 215/220 |
| 3,650,426 | 3/1972 | Miller | 215/220 |
| 3,692,199 | 9/1972 | Mumford | 215/220 |
| 3,722,727 | 3/1973 | Gach | 215/220 |

*Primary Examiner*—George T. Hall

*Attorney, Agent, or Firm*—Wegner, Stellman, McCord, Wiles & Wood

[57] ABSTRACT

A safety closure is disclosed which is a one piece plastic molded overcap intended for use with a standard metal screwcap extensively used to close containers of dangerous and toxic materials. The overcap is intended to readily useable manipulation by adults to apply the standard screwcap to a container and to remove the standard cap from a container, but is intended to prevent unauthorized opening by young persons, such as small children.

3 Claims, 5 Drawing Figures

Fig. 1
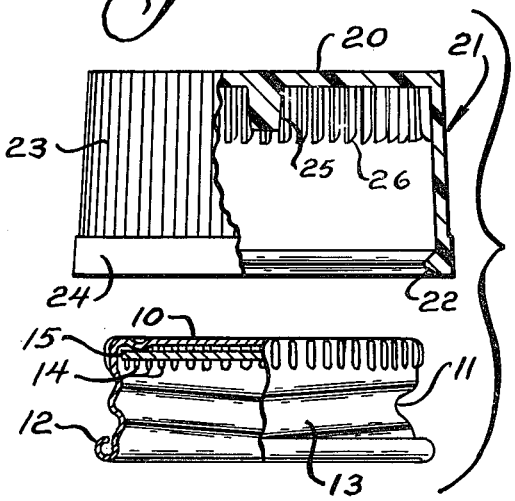
Fig. 2
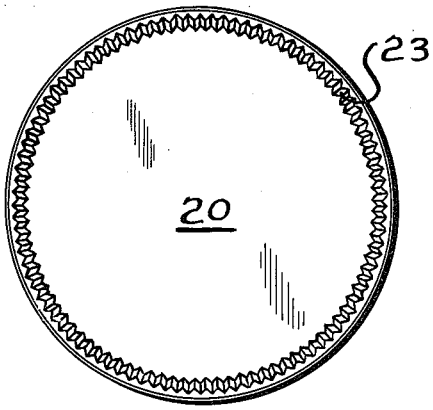
Fig. 4
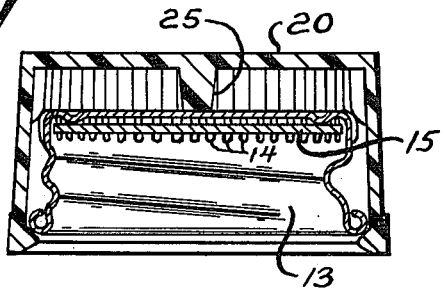
Fig. 5
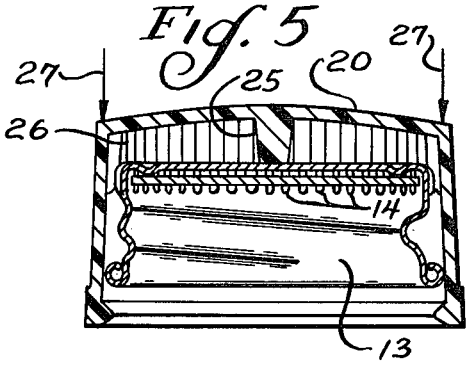
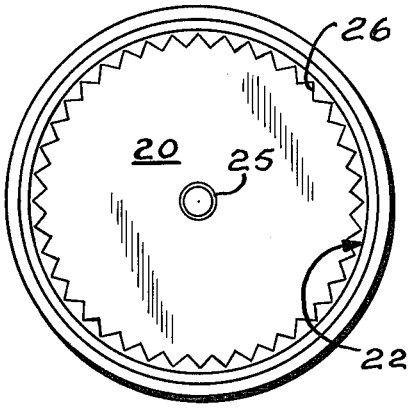
Fig. 3

SAFETY OVERCAP FOR STANDARD METAL SCREWCAPS

BACKGROUND OF THE INVENTION

A great many ingenious safety caps have been designed to prevent children's access to containers in which materials may be packaged which might injure the child if he had access thereto. Many of such caps have employed a special design of an inner cap and an outer cap which are so related, one to the other, that adults can, by following simple instructions, open the container, whereas a child, unable to read or understand instructions, cannot so open the container. The Poison Prevention Act of the U.S. has promulgated many such closures.

There has been a need, however, in the packaging and filling industry to have a simply applied overcap capable of use upon the standard metal screwcaps, which are in use extensively. The requirements of being able to machine-apply a cap to a standard metal screwcap and yet allow its subsequent use by adults to open and close the container has been present for some time. The present invention provides a simple, one-piece molded cap, which may be applied upon filling machinery by a simple downward straight-line motion applied to the container after it has received the standard metal screwcap closure. Once applied, the overcap will freewheel on the standard metal cap until pressure is applied to it in a prescribed manner to allow the overcap to operationally engage the standard metal cap for opening or closing motion.

SUMMARY OF THE INVENTION

It is the principal object of this invention to provide a new and useful safety overcap for standard metal screwcaps widely in use in industry and trade.

It is a further object of this invention to provide a safety overcap made of a flexible plastic material so formed that parts thereof will allow the overcap to freewheel upon a standard metal screwcap, and flexibility of one or more parts thereof will allow engagement of teeth in the overcap with the standard knurling on the metal screwcap for turning motion of the overcap to the underlying standard screwcap.

Another object is to provide for the structure of a safety overcap totally enclosing a standard metal screwcap preventing the opening of a container so equipped except by persons capable of following simple pressure applying instructions.

DESCRIPTION OF THE DRAWINGS

FIG. 1 is a side elevational view, partly in section, of the overcap in exploded relation to a standard metal screwcap;

FIG. 2 is a top plan view of the overcap illustrated in FIG. 1;

FIG. 3 is a bottom plan view of the overcap illustrated in FIG. 1;

FIG. 4 is a central upright cross-sectional view of an assembly of the overcap and the standard metal screwcap in its freewheeling position; and FIG. 5 is a view similar to FIG. 4, showing postion of the overcap relative to the standard screwcap in a drive engaging position of the overcap to the standard cap.

DESCRIPTION OF THE PREFERRED EMBODIMENT

The overcap of this invention is intended to be used as a safety cap to be applied directly over the standard metal caps which are widely used. Standard caps are generally made in three sizes, nominally 1 in., 1¼ inches and 1¾ inches, which generally refers to the diameter of a screw neck upon which the cap is intended to be used. The screwcaps are formed of sheet metal, provided with a gasket which may be glued or physically mounted in the upper end of the cap and further provided with screw threads for mating with standard threads on a container neck. Such a standard metal screwcap is shown in the drawings (FIGS. 1, 4 and 5) in a 1 inch size, slightly enlarged, in which the metal cap has a top wall 10 with a depending circular skirt 11 ending in a rolled rim or curl or enlarged bulge 12 at the lower edge portion thereof. Screw threads 13 are formed in the wall of the metal cap in a fashion standard to the industry. Corrugations or knurls 14 are formed in the upper sidewall of the depending skirt of the cap adjacent the top wall 10. Standard screw caps are generally equipped with a gasket 15 intended to be sealed against a container neck wall.

The overcap of this invention may be formed of a flexible metal or a suitable flexible plastic, such as polyethylene, and when so formed is intended to completely enclose and embrace the standard metal screwcap. The parts of the overcap are clearly illustrated in FIGS. 1–3 in which the cap has top wall 20 and a depending skirt 21 of sufficient height to completely enclose the skirt of the standard metal screwcap. The lower extremity of the skirt 21 is formed with an inwardly projecting annular rib or flange 22 sized slightly smaller than the diameter of the curl 12 at the lower end of the standard cap. The flexible material of the outer cap will permit the flange 22 to enlarge in ring fashion sufficiently to slip over and past the lower edge curl 12 on the standard cap and to repose below that curl as illustrated in FIG. 4 to retain the overcap on the standard cap. The external surface of the depending skirt of the overcap has ribs 23 generally extending from a plain outer ring surface 24 opposite the inwardly projecting flange 22 to the top wall 20.

One overcap found to be effective for use with a nominal 1 inch standard metal screwcap, made of polyethylene, has a top wall 20 of about a 0.040 inch thickness with sidewalls including ribs 23 of about 0.075 inch thickness. The overcap top walls have a diameter of 1 3/16 inches and the outer extremities of the lower edge of the sidewall has a diameter of about 1 5/16 inches with the overall height of the cap about 11/16 inch.

The cap may be applied to a container on which a standard metal cap has been placed and machine screwed tight by simply placing the cap loosely over the metal cap and applying downward pressure to force the flange 22 over the curl on the lower rim of the standard cap. This pressure may be machine or hand applied and in production is expected to be automatically applied to each container as it progresses in a filling assembly line.

When the overcap is applied over a standard cap with the flange 22 below the curl a central post 25 depending from the central part of the top wall 20 will engage upon the central portion of the top wall 10 of the inner cap. This condition is illustrated in FIG. 4 and in such a condition teeth 26 formed on the inside of the upper skirt wall 21 will be held out of engagement with the corrugations or knurls 14 in the metal cap. Teeth 26 are configured to mate with standard corrugations 14 in metal screwcaps. A child grasping the outer cap and being incapable, or not knowing how to apply any particular pressure thereto, will not be able to engage the teeth or corrugations in the outer cap with the knurling on the standard metal cap. The top wall 20 being contiguous to the teeth 26 on the inside of the plastic cap, substantially prevents collapse of the teeth into the knurling on the metal cap by any pressure applied across the outer cap generally in the plane of the top wall.

An adult following instructions may easily cause the outer cap to interengage with the standard cap for opening and closing a container on which it is mounted. Instructions generally are printed or affixed to the outer cap telling a person wishing to open the container to apply pressure at the juncture of the top wall with the depending skirt generally in the directions of arrows 27 (see FIG. 5). Under such conditions, the top wall is caused to flex over the post 25 as a fulcrum, to lower the outer cap relative to the inner cap allowing the teeth 26 to engage the corrugations 14 at the upper edge of the metal cap. The teeth 26 being shaped to mate with corrugations on a standard metal cap, thus engage in a driving relation. While pressure is so applied at the top edges of the outer cap, the inner cap may be caused to turn either clockwise or counterclockwise for closing or opening the container. Once the pressure is removed, the flexibility of the material of the outer cap causes a movement from the FIG. 5 to the FIG. 4 position.

A relatively small post has been found adequate for the purposes, and in the example of a cap for a 1 inch standard metal cap, the post may be of circular cylindrical form of about $\frac{1}{8}$ inch diameter. The length of the post is generally equal to the length of the teeth on the inner portion of the outer cap so as to hold the bottom portion of teeth just above the corrugations on a standard metal screwcap.

While the preferred construction relies mostly upon flexibility of the top wall 20 of the overcap to permit engagement of the two caps for opening and closing, some deformation or compression of both the post and the top wall of the standard cap may also contribute to allowing pressure applied to the edges of the overcap to effect the driving connection. Also, the post 26 may be replaced by a plurality of smaller posts clustered about the center of the wall 20, each post being somewhat compressible or flexible under manually applied pressure to aid in allowing the overcap to lower over the standard cap. In the event flexibility or compressibility of the post is utilized, sizing and material should permit of sufficient resiliency to spring the overcap back to its freewheeling relation to the standard cap upon removal of applied pressure.

I claim:

1. A safety closure overcap for standard metal screwcaps having a lower edge curl and finger gripping knurl in the sidewall adjacent a juncture with a top wall, comprising:

a plastic material molded inverted cup-shaped overcap having a top wall and depending sidewalls, said sidewalls having a height in excess of the height of the standard cap sidewall, an annular inwardly directed flange on the overcap sidewall sized to snap over the standard cap knurl and hold the overcap assembled on the standard cap, a knurl in the interior upper sidewall of the overcap mating the standard cap knurl, and a post centrally inside the overcap top wall extending toward and adapted to engage the top wall of the standard cap to hold the overcap knurls out of engagement with the standard cap knurls unitl finger pressure upon the overcap applied above the sidewalls flexes the overcap top wall over the post acting as a fulcrum to engage the knurls in driving torque for both on and off movement of the inner screwcap.

2. An outer cap for association as a safety overcap for a standard metal closure cap of the type having a relatively flat top wall and a depending skirt with knurling on the upper edge portion of said skirt and with threads in the skirt below said knurling and with a outwardly rolled rim at the lower edge portion of the skirt for threading the standard cap onto and off of a complementary threaded container neck, said outer cap being formed of a resilient plastic material and comprising a top wall to overlie the top wall of the standard cap and a depending skirt of sufficient height to completely encircle the skirt of the standard cap, a radially inwardly extending flange integrally formed on the lower edge of the outer cap depending skirt in position to snap over and engage below said rolled rim for trapping the outer cap on the standard cap, a post centrally inside the outer cap top wall depending into engagement with the top wall of said standard cap, said post and cap top wall holding said outer cap in an elevated position on the standard cap, said top wall being sufficiently yieldable to bend over said post in response to the manual application of external pressure at the periphery of said cap top wall, internal teeth in the upper portion of the outer cap skirt configured to mate with said knurling, said post normally holding said teeth out of engagement with said knurling until pressure applied to said outer cap at the juncture of said top wall and skirt moves the outer cap from said elevated to a lower position to engage the teeth and knurling, said outer cap flexible material springing said outer cap to such elevated position upon removal of such applied pressure.

3. A safety closure overcap for standard knurled metal screwcaps, comprising:

an inverted cup-shaped integral molded overcap adapted to enclose said standard metal screwcap and to be self-retaining on said screwcap, an upper resiliently flexible top wall having a depending post centrally thereof for engaging the central portion of the metal screwcap to hold the overcap in freewheeling assembly with the screwcap, overcap sidewalls depending from the top wall and having an annular inwardly directed flange sized to engage under a rim on said screwcap to hold the overcap assembled to the screwcap, and knurls internal of said sidewalls adjacent said top wall sized to engage said screwcap knurls when the top wall is flexed over said post under applied finger pressure upon sidewall and top wall juncture, to lower the knurls into engagement.

* * * * *